US005429450A

United States Patent [19]

Meidinger

[11] Patent Number: 5,429,450

[45] Date of Patent: Jul. 4, 1995

[54] EROSION CONTROL BARRIER

[76] Inventor: Louise Meidinger, 106 West Market St., Rockaway Point, N.Y. 11697

[21] Appl. No.: 225,785

[22] Filed: Apr. 11, 1994

Related U.S. Application Data

[63] Continuation-in-part of Ser. No. 133,325, Oct. 8, 1993, abandoned.

[51] Int. Cl.[6] ..... E02B 3/00; E02B 17/20

[52] U.S. Cl. ..... 405/15; 405/33; 405/258

[58] Field of Search ..... 405/15, 16, 21, 25, 405/33, 258

[56] References Cited

U.S. PATENT DOCUMENTS

| | | | |
|---|---|---|---|
| 1,893,003 | 1/1933 | Schlueter | 405/33 |
| 2,069,715 | 2/1937 | Arpin | 405/25 |
| 2,466,343 | 4/1949 | Weber | 405/33 |
| 3,844,125 | 10/1974 | Williams | 405/33 |
| 5,102,257 | 4/1992 | Creter | 405/25 |
| 5,114,270 | 5/1992 | Riddle | 405/15 |

FOREIGN PATENT DOCUMENTS

| | | | |
|---|---|---|---|
| 4223335 | 1/1993 | Germany | 405/15 |

*Primary Examiner*—David H. Corbin
*Attorney, Agent, or Firm*—Michael I. Kroll

[57] ABSTRACT

The present invention relates to a linear revetment system comprising interconnecting erosion prevention curbs having connecting means abd fin-like projections extending downward into the soil to prevent erosion.

5 Claims, 2 Drawing Sheets

EROSION CONTROL BARRIER

This application is a continuation-in-part of application Ser. No. 08/133,325 filed on Oct. 8, 1993, abandoned.

FIELD OF THE INVENTION

The present invention relates to an agricultural implement for soil erosion control.

This invention relates to erosion control systems, and more particularly to an erosion control system which utilizes a plurality of linear erosion prevention curbs having tongue and cavity coupling means to form an entire revetment comprised of land placed erosion prevention curbs and/or preassembled machine-placed interlocking linear erosion prevention curb mats.

DESCRIPTION OF THE PRIOR ART

Erosion of soil from cultivated land often occurs as a consequence of rapid and unimpeded run-off of rain water.

The present invention has been devised with the general object of greatly reducing this without undue disturbance or up-turning of the soil which makes the land difficult to drive across. An object achievable in preferred forms of the invention is to provide such an implement which is capable of operation over land which has been mulched with trash, and which will assist in penetration of the soil by the trash.

The erosion of natural and artificial channels, beaches, and other points where water interfaces with soil is a frequently encountered and much studied problem. Erosion can be the result of abrasion, which is the removal of material from the surface of a bank. The primary cause of abrasion is the movement of water along the soil/water interface, with contributing factors being high velocities, currents, waves, long-eddies and boat wash.

Various revetment systems have been used in attempts at preventing, or at least slowing, erosion. Randomly sized concrete chunks, or "riprap", have been placed along riverbanks and beaches in attempts to slow erosion. Too often, though, the chunks would be too large and some erosion would still occur. Similarly, attempts at paving have been futile due to the destructive effects of hydrostatic pore pressure.

Recently, revetment constructions utilizing interconnected erosion prevention curbs have become known. These constructions typically involve placing erosion prevention curbs of various shapes into a mat which in turn, is placed along the riverbank or beach. These mats make intimate contact with the underlying soil during settlement and prevent realignment of the slope by wave and current action. However, because such constructions have ignored one or more basic considerations, there has yet to exist a truly effective means of preventing hydrodynamic failures due to rain, waves and currents.

One overlooked consideration involves the "uplifting" of entire revetments due to hydrostatic pore pressure. When water passes between the bottom of a revetment, or an individual erosion prevention curb, and the earth, hydraulic action takes place. This, for example, results when waves of passing vessels and natural variable frequency and wave heights cause turbulence, thereby affecting water pressures under the revetment and in the subsoil. When the uplift pressure forces become greater than the sum of the weight of the erosion prevention curb and its friction forces, a loss of stability occurs, and one or more erosion prevention curbs can be lifted from the revetment.

A second overlooked consideration is that the interconnected erosion prevention curbs must be permitted to shift within reasonable bounds within the arrangement so as to avoid any individual erosion prevention curb taking the entire destructive force outlined above, and yet be restrained so as not to become dislodged. This is extremely important when concrete, which is low in tensile strength, is used to produce the erosion prevention curbs.

Another overlooked consideration relates to the means used to interlock the erosion prevention curbs. Reinforcing or connecting rods and cables made of material subject to corrosion, such as steel, are traditionally used because unlike plastic, such materials best withstand attempted vandalism and do not break down upon exposure to sunlight. However, corrosion of such cables, when surrounded in concrete, causes the concrete to expand, which in turn results in spalling. Once spalling of the concrete takes place, the erosion prevention curbs are apt to crack or disintegrate and the entire revetment can be lost. Attempts at replacing such cables using erosion prevention curbs having interconnecting members have been made, but all have failed. Such interconnections have involved either solely horizontal locking members or have failed to allow the movement of members outlined above, or both.

Another important, yet unmet, consideration is cost effectiveness. Any efficient erosion control system must have low production and application costs. To keep costs low, the erosion prevention curbs must be of such design that they can be quickly assembled at a desired location in a systematic fashion without auxiliary components and by relatively unskilled labor.

Numerous innovations for erosion prevention devices have been provided in the prior art that are adapted to be used. Even though these innovations may be suitable for the specific individual purposes to which they address, they would not be suitable for the purposes of the present invention as heretofore described.

SUMMARY OF THE INVENTION

The above considerations are embodied in the present invention, which is directed to a hand-placed erosion prevention curb-formed revetment for controlling soil erosion.

Each erosion prevention curb has, as its main body, a linearly shaped interlocking and connecting means extending at the distal ends of the curb. Either a tongue or a cavity capable of coupling with such tongue on its distal ends. The shape of each tongue and cavity is such as to allow the tongue some movement within the cavity while preventing total horizontal or vertical dislocation. This encourages a small amount of controlled movement among the erosion prevention curbs and prevents breaking off of tongues during such movement. When horizontal or vertical movement occurs no single vertical face or tongue and cavity takes the full impact. Rather, the impact is distributed over the full length and tongues.

According to one embodiment of the invention, three types of erosion prevention curbs are used, each having a linear arrangement. Another erosion prevention curb type has a concave shaped arrangement. Optionally, a third arrangement may be convexly shaped. These erosion prevention curbs enable a cable to pass through a curb without exposure when double cabled curbs are used.

Each erosion prevention curb may also have a plurality of holes extending from the top surface through the erosion prevention curb to bottom of the curb. These holes aid in reducing hydrostatic pressure, create a high flow resistance, an allow vegetation to grow through the erosion prevention curbs so as to further stabilize the curb comprised of a plurality of the erosion prevention curbs.

Furthermore, the holes produce eddy currents as the water traverses over the erosion prevention curb, and thereby increase flow resistance.

Each erosion prevention curb may have a through tunnel and fin-like system at a point located on its bottom and traveling through at least one tongue and ending at a cavity. The uniform location of the tunnel and fin-like projections allow arrangements of different heights, and hence, different weights, to be interconnected as needed. Various types of steel cables, rods, or high tensile plastic or other non-corrodible material may be passed through the tunnels and fin-like projections of interconnected erosion prevention curbs. This allows a curb to be pre-assembled on land and placed as a unit into final position in and along the water or hill side. The parallel location of the interconnections results in a curb with a catenary curve conducive to lifting. Without such a catenary curve, the erosion prevention curbs would crack upon being lifted. The cable or rods may remain in the positioned curb to provide greater stability if desired. Because each cable travels through the interconnected tongues and cavities, it is not exposed as it passes between erosion prevention curbs. This prevents vandalism and disintegration of plastic cables due to sunlight. Also, since the erosion prevention curbs are mechanically interconnected, fewer cables are needed as compared to revetment means as traditionally used.

The assembly of the curb is accomplished by placement of the cavity of one erosion prevention curb over a tongue of another. Additional couplings are made until a curb of juxtaposed erosion prevention curbs is formed. If assembly is to be done without cables and at a point of final position, such as within the water, only the interior type of erosion prevention curbs need be used. If assembly is off-site, a row of inner edge erosion prevention curbs is connected to one edge of the curb so that a cavity appears on each exposed vertical wall of an inner curb edge, and a row of outer edge erosion prevention curbs is connected at the opposite edge of the curb so that a tongue appears on each exposed vertical wall of an outer curb edge. Upon placing the curbs into final position, the tongued outer edge of a first curb can be interconnected with the cavitied inner edge of a second curb. Additional curbs can be similarly connected to produce a revetment of any desired length. Likewise, an upper curb edge having a series of exposed cavities is formed at one end of the curb, and a lower curb edge having a series of exposed connecting tongues is formed at the opposite end. The tongued lower curb edge of a first curb can be interconnected with the cavitied upper edge of a second curb to produce a revetment of any desired width.

The invention, therefore, is useful in preventing washing away of shoreline, hill side, as well as in a desert, along a highway, or other instances where erosion is a problem.

It is, therefore, an object of this invention to provide a erosion prevention curb which will couple with other similar erosion prevention curbs without separate or auxiliary interconnecting means to form a revetment capable of controlling erosion of soil.

It is a further object of this invention to provide a erosion prevention curb which, when coupled with other erosion prevention curbs, allows a limited amount of movement of both the erosion prevention curbs themselves and their connecting tongues.

It is a still further object of this invention to provide a erosion prevention curb which, when coupled with other erosion prevention curbs, forms a curb which allows minimum space between its bottom surface and the subsoil.

It is another object of this invention to provide a erosion prevention curb and revetment curb which reduces the effects of hydrodynamic pressure.

It is yet another object of this invention to provide a erosion prevention curb and revetment curb through which vegetation can grow.

It is still another object of this invention to provide a erosion prevention curb and revetment curb which allows a cable or rod or tubing to be placed through hand placed erosion prevention curbs to provide increased resistance to hydraulic uplift.

It is yet a further object of this invention to provide a erosion prevention curb which, when coupled with other erosion prevention curbs, eliminates the dislocation of connecting means by vertical or horizontal force.

It is still another object of this invention to provide a erosion prevention curb which, when coupled with other erosion prevention curbs, has a curve.

It is still another object of this invention to provide a erosion prevention curb which, when coupled with other erosion prevention curbs, minimizes exposure of any connecting cable passing between the erosion prevention curbs.

It is still another object of this invention to provide a erosion prevention curb of uniform design which can be assembled into an arrangement quickly and by minimally skilled labor.

It is yet still another object of this invention to provide a revetment curb capable of being preassembled arrangement to form an assembly of any length and width.

It is also a further object of this invention to provide a revetment curb which is sufficiently flexible so as to accomodate the contours of the site upon which it is installed.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

Figure 1:
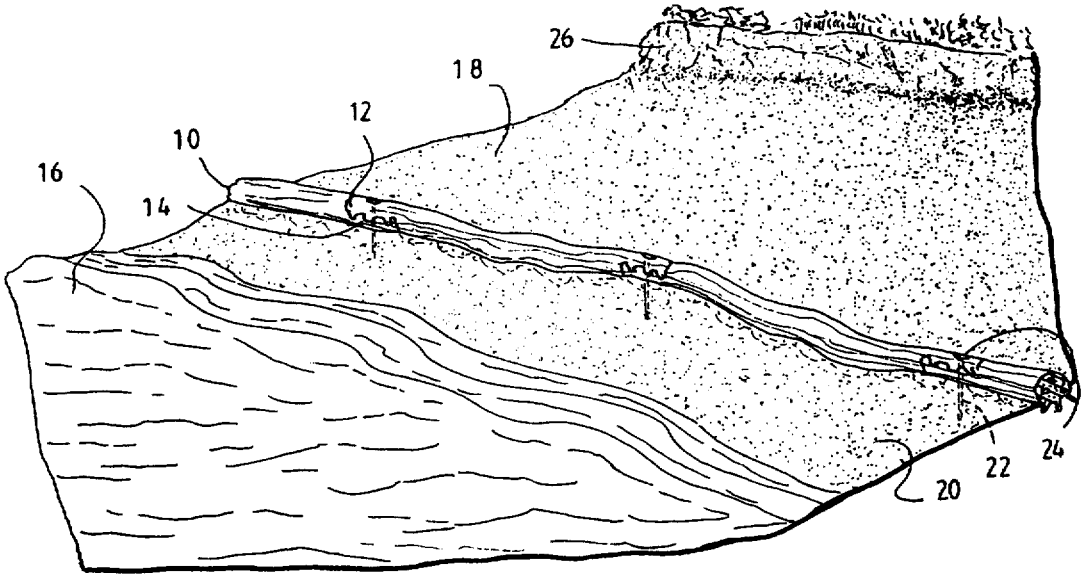
FIG. 1 is a perspective view of an inclined hill side with non-eroded soil located in front of and above the erosion control barrier.

10 —Erosion control barrier
12 —Male distal end
14 —Female distal end
14A —Female outer/male inner joint
14B —Female middle/male middle joint
14C —Female inner/male outer joint
16 —Eroded soil
18 —Non-eroded soil
20 —Pre-eroded soil
22 —Spike
22A —Spike head
22B —Spike middle
22C —Spike point
24 —Joint-like fastening male and female distal ends
26 —Inclined hill
28 —Fin cleave
30 —Middle of spike
32A —Outer male fastener
32B —Middle male fastener
32C —Inner male fastener
34A —Inner female fastener
34B —Middle female fastener
34C —Outer female fastener
36A —Inner fin
36B —Middle fin
36C —Outer fin
38A —Male distal end solid core
38B —Female distal end solid core
40 —Reinforcement member
42 —Core substance
44A —Inner male/Outer Female joint
44B —Middle male/middle female joint
44C —outer male/inner female joint
46A —Spike inner hole
46B —Spike outer hole
46C —Angled spike outer hole
48 —Male blunted terminal end
50 —Female blunted terminal end
52 —Concave configuration
54 —Straight configuration
56 —Convex configuration

DETAILED DESCRIPTION OF THE PREFERRED EMBODIMENT

Referring to FIG. 1 which depicts a perspective view of an inclined hill side 26 with non-eroded soil 18 located in front of and above the erosion control barrier 10. The Erosion control barrier prevents the slippage of soil as exhibited in the eroded soil 16 when heavy rains or other inclicurbed and adverse weather conditions occur. Due to the incline of the hill, the non-eroded soil begins to loosen forming a pre-erosion soil condition 20 hence, resulting in eroded soil 16. The erosion control barrier 10 prevents such soil erosion by firming up the incline of the hill, thus, preventing pre-eroded 20 and eroded soil 16 conditions from occurring. The erosion control barrier 10 consists of interlocking linear log-like erosion control barrier 10 each of which have a male distal end 12 and a female distal end 14 when interconnected form a tight joint being fastened together by a spike 22.

Figure 2:
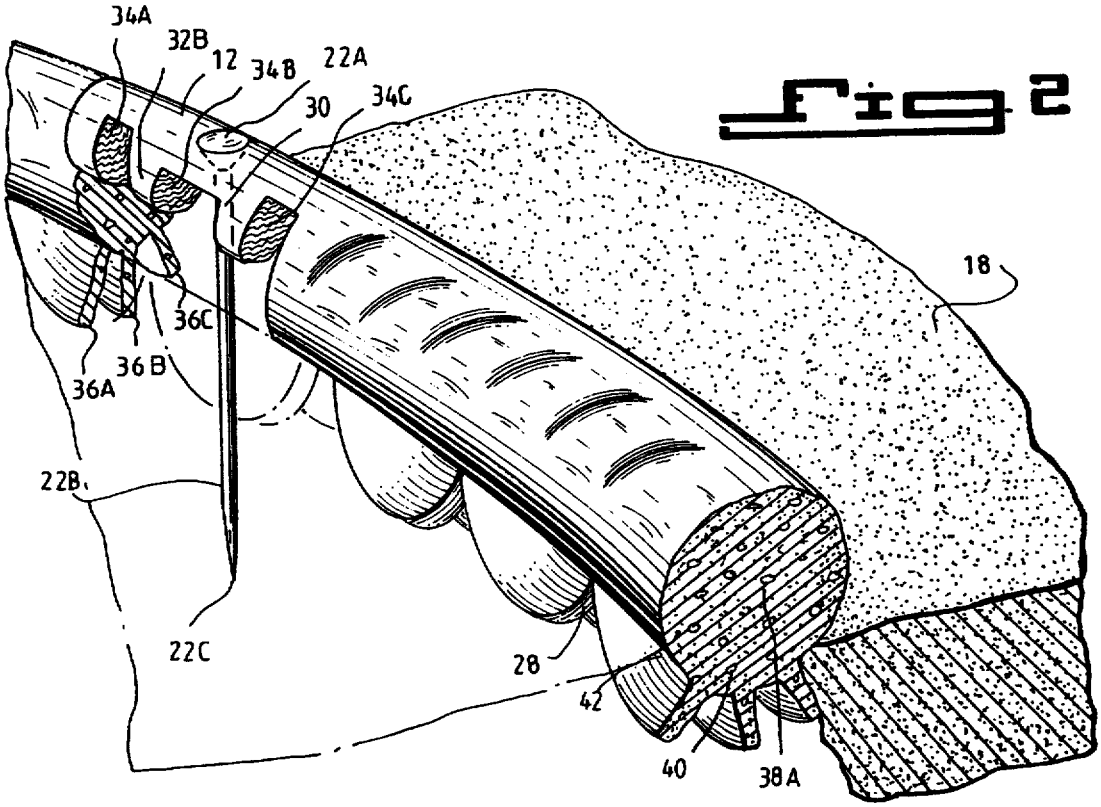
FIG. 2 is a perspective cross sectional view of the erosion control barrier, the male distal end having joint forming components such as an outer male fastener, a middle male fastener, and an inner male fastener with oppositely intergrately formed female distal end consists of components such as an inner female fastener, a middle female fastener and an outer female fastener.
Figure 4:
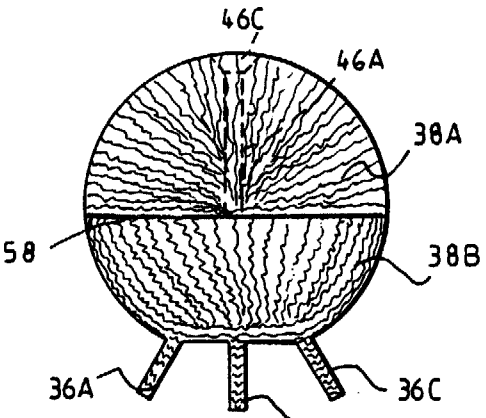
FIG. 4 is a cross sectional view of a erosion control barrier having a male distal end solid core and an opposing complimentary female distal end solid core as well as a lower portion of the erosion control barrier having fin-like projections extending outwardly.

Referring now to FIG. 2 which is a perspective cross sectional view of the erosion control barrier 10, the male distal end 12 having joint forming components such as an outer male fastener 32A, a middle male fastener 32B, and an inner male fastener 32C. Oppositely intergrately formed female distal end 14 consists of components such as an inner female fastener 34A, a middle female fastener 34B and an outer female fastener 34C. The Female distal end 14 and the male distal end 12 are joined together by a spike 22 having a spike head 22A, a spike middle 22B and a spike point 22C. Hence, a joint is formed joining the male and female distal ends 24. The erosion control barrier 10 has fin-like projections extending at different angles from the bottom portion of the erosion control barrier 10 consisting of an inner fin 36A, a middle fin 36B and an outer fin 36C, as seen in FIG. 4. The fin-like projections extend outwardly from the erosion control barrier 10 into the non-eroded soil 18 to hold tight the soil, thus preventing pre-eroded soil 20 and eroded soil 16 from occurring. The erosion control barrier 10 may have reinforcement members 40 contained within the core substance 42.

Figure 3:
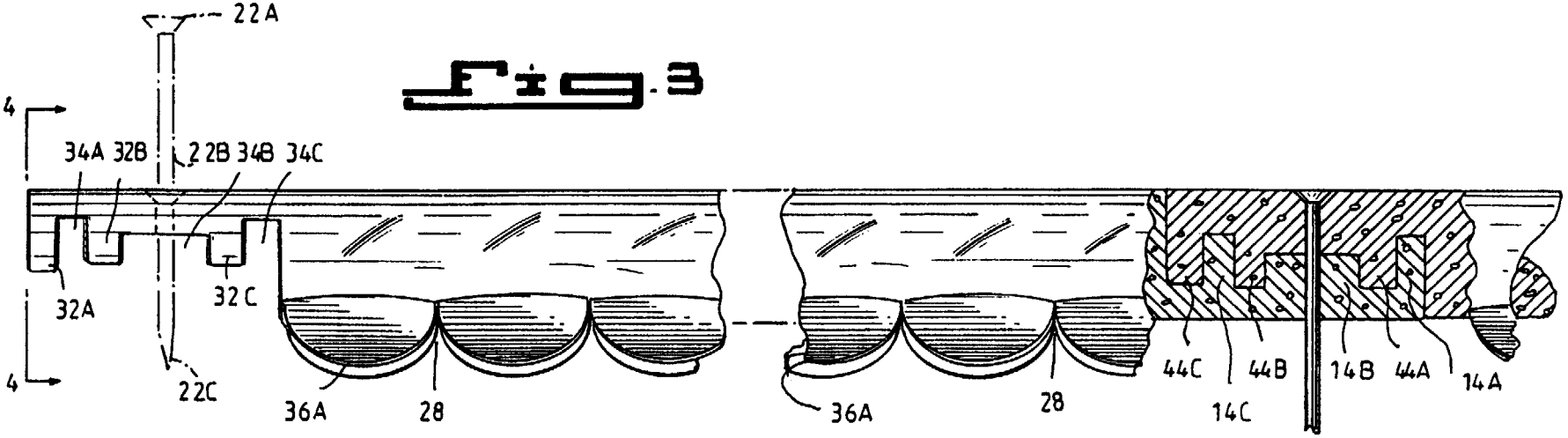
FIG. 3 is a side cross sectional view of a erosion control barrier exhibiting the insertion of a spike by driving the spike head by a powering means, thus, the spike middle is located between the male distal end and the female distal end.

Referring to FIG. 3 which is a side cross sectional view of a erosion control barrier 10 exhibiting the insertion of a spike 22 by driving the spike head 22A by a powering means,thus, the spike middle 22B is located between the male distal end 12 and the female distal end 14. The spike 22 has a spike point 22C which facilitates the insertion of the spike 22 into and through the male distal end 12 and the female distal end 14. The male distal end having components such as an inner male fastener 32C, a middle male fastener 32B and an outer male fastener 32A. The male fasteners have corresponding female counterpart fasteners such as an inner female fastener 34A, a middle female fastener 34B and an outer female fastener 34C. When the male distal end 12 and the female distal end 14 are joined together by a series of joints such as an inner male/outer female joint 44A, a middle male/outer female joint 44B, and an outer female/inner male joint 44C. The complimentary joints are as follows; female outer /male inner joint 14A, female middle/male middle joint 14B and female inner/-male outer joint 14c. Said Joints are held together by a spike 22 which also fastens the entire erosion control barrier 10 into the non-eroded soil 16. The erosion control barrier 10 has fin-like projections which may have fin cleaves 28 interspersed therein. Said joints are joined with aa middle of spike section 30 thereby securely and tightly fastening said joints together.

Referring to FIG. 4 which is a cross sectional view of a erosion control barrier 10 having a male distal end solid core 38A and an opposing complimentary female distal end solid core 38B. The lower portion of the erosion control barrier 10 has fin-like projections extending outwardly consisting of an inner fin 36A, a middle fin 36B and outer fin 36C. These fin-like projections extend outwardly into the non-eroded soil 18 preventing slippage of the non-eroded soil 18, thus preventing pre-erosion 20 and erosion 16 from occurring.

Figure 5:
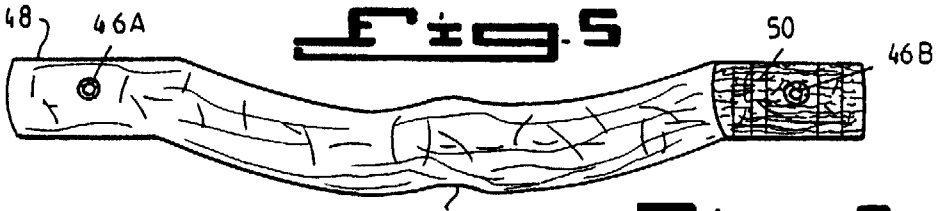
FIG. 5 is a top view of one configurations of the erosion control barrier exhibiting a male blunted terminal end and a female blunted terminal end which interlocks therebetween a male distal end and a female distal end such that the erosion control barrier can be configured in a concave arrangement.
Figure 6:
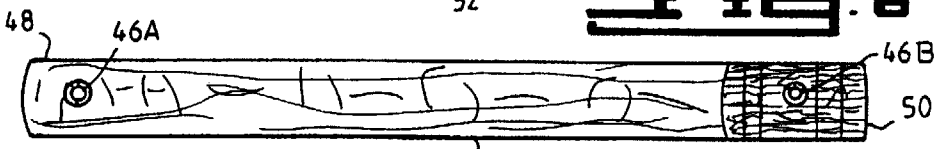
FIG. 6 is a top view of one configurations of the erosion control barrier exhibiting a male blunted terminal end and a female blunted terminal end which interlocks therebetween a male distal end and a female distal end such that the erosion control barrier can be configured in a straight arrangement.
Figure 7:
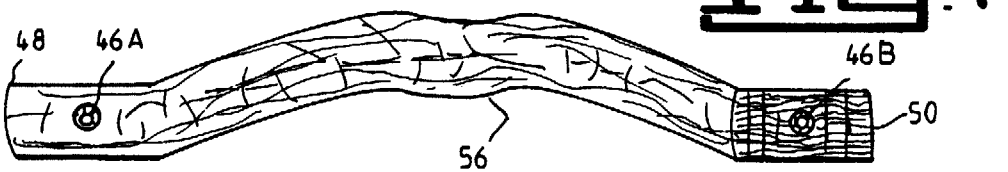
FIG. 7 is a top view of one configurations of the erosion control barrier exhibiting a male blunted terminal end and a female blunted terminal end which interlocks therebetween a male distal end and a female distal end such that the erosion control barrier can be configured in a convex arrangement.

Lastly, referring to FIGS. 5, 6 and 7 are top views of different configurations of the erosion control barrier 10 exhibiting male blunted terminal end 48 and a female blunted terminal end 50 which interlocks therebetween the male distal end 12 and the female distal end 14. The distal ends have spike inner holes 46A with a distal transitional angled spike outer hole 46C terminating at a spike outer hole. The erosion control barrier 10 can be configured concavely 52, straight 54 and convex 56 arrangements. Hence, the aesthetic appearance of the erosion control barrier 10 can be conformed to a person's individual architectural designs and taste.

It will be understood that each of the elements described above, or two or more together, may also find a useful application in other types of constructions differing from the type described above.

While the invention has been illustrated and described as embodied in a erosion prevention barrier, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An erosion control barrier comprising:

a) a plurality of extended solid members, each extended solid member of generally cylindrical cross section having one end with male projections extending therefrom and a second end with notches engaging the male projections of the next adjacent solid member, the ends of said adjacent members overlapping each other to form a log-like barrier located on the surface of the ground where erosion is to be prevented, b) a fastening means functioning to connect both overlapping ends when said erosion control barrier is arranged in interlocking series, c) erosion control soil slippage retainer means comprising inner, middle, and outer fin-like projections extending downwardly at different angles from the bottom portion of each of said solid members into the ground.

2. An erosion control barrier as described in claim 1, whereas said fastening means is a spike.

3. An erosion control barrier as described in claim 1, whereas said fastening means is easily connected and disconnected.

4. An erosion control barrier as described in claim 1, whereas said retainer fin-like projections are extended in a scalloped-like configuration whereby said fin-like projections are interspersed with cleaves.

5. An erosion control barrier as described in claim 1, whereas said barrier can be configured from a group of shapes such as concave, convex, straight, wave-like, random, twisted and the like.

* * * * *